US007434807B2

(12) United States Patent
Wong

(10) Patent No.: US 7,434,807 B2
(45) Date of Patent: Oct. 14, 2008

(54) TARACCAB OR BACCARAT TABLE CARD GAME WITH CHINESE DECK

(75) Inventor: Jacob Y. Wong, Goleta, CA (US)

(73) Assignee: Gamelot, Inc., Goleta, CA (US)

( * ) Notice: Subject to any disclaimer, the term of this patent is extended or adjusted under 35 U.S.C. 154(b) by 236 days.

(21) Appl. No.: 11/128,529

(22) Filed: May 14, 2005

(65) Prior Publication Data

US 2006/0181027 A1 Aug. 17, 2006

Related U.S. Application Data

(63) Continuation-in-part of application No. 11/058,471, filed on Feb. 14, 2005.

(51) Int. Cl.
*A63F 1/00* (2006.01)

(52) U.S. Cl. ..... 273/274; 273/292

(58) Field of Classification Search ..... 273/274, 273/292, 309

See application file for complete search history.

(56) References Cited

U.S. PATENT DOCUMENTS 4,836,553 A * 6/1989 Suttle et al. ..... 273/292
5,390,934 A * 2/1995 Grassa ..... 273/292
6,688,598 B1 * 2/2004 Hsi ..... 273/292

OTHER PUBLICATIONS

Asian Games:The Art of Contest, Asia Society, p. 222, 2004.*
http://en.wikipedia.org/wiki/Baccarat, website describing the game of Baccarat, 7 pgs., Dec. 2003.*
European & Asian Games, Gambling Times Incorporated, 1018 N. Cole Ave., Hollywood, CA 90038, pp. 73-75, 202, 1986.*

* cited by examiner

*Primary Examiner*—William M Pierce
(74) *Attorney, Agent, or Firm*—Wagner, Anderson & Bright, LLP; Roy L. Anderson

(57) ABSTRACT

A game uses a deck of cards having three sets of cards with designations 1 through 9, five cards with a Feng Shui designation, four cards with a Green Dragon designation, four cards with an East Wind designation, four cards with a South Wind designation, four cards with a West Wind designation and four cards with a North Wind designation. A player and a dealer hand, each with two cards, is generated and then it is determined whether either or both hands will receive one more card (the player hand can get hit if its cards have a ranking below a first number while the dealer hand can get hit if its cards have a ranking below a second, higher number) and then the hand with the highest ranking of cards is declared the winner. The rankings are based upon pairs of cards according to a preselected order. Players can be allowed to bet on the player's hand or the dealer's hand although a rake is taken from winnings bet on the dealer's hand and bonus bets can be paid when the winning hand is a certain ranking. The game can also be played in a blackjack fashion where multiple players can only bet against a house hand.

14 Claims, 5 Drawing Sheets

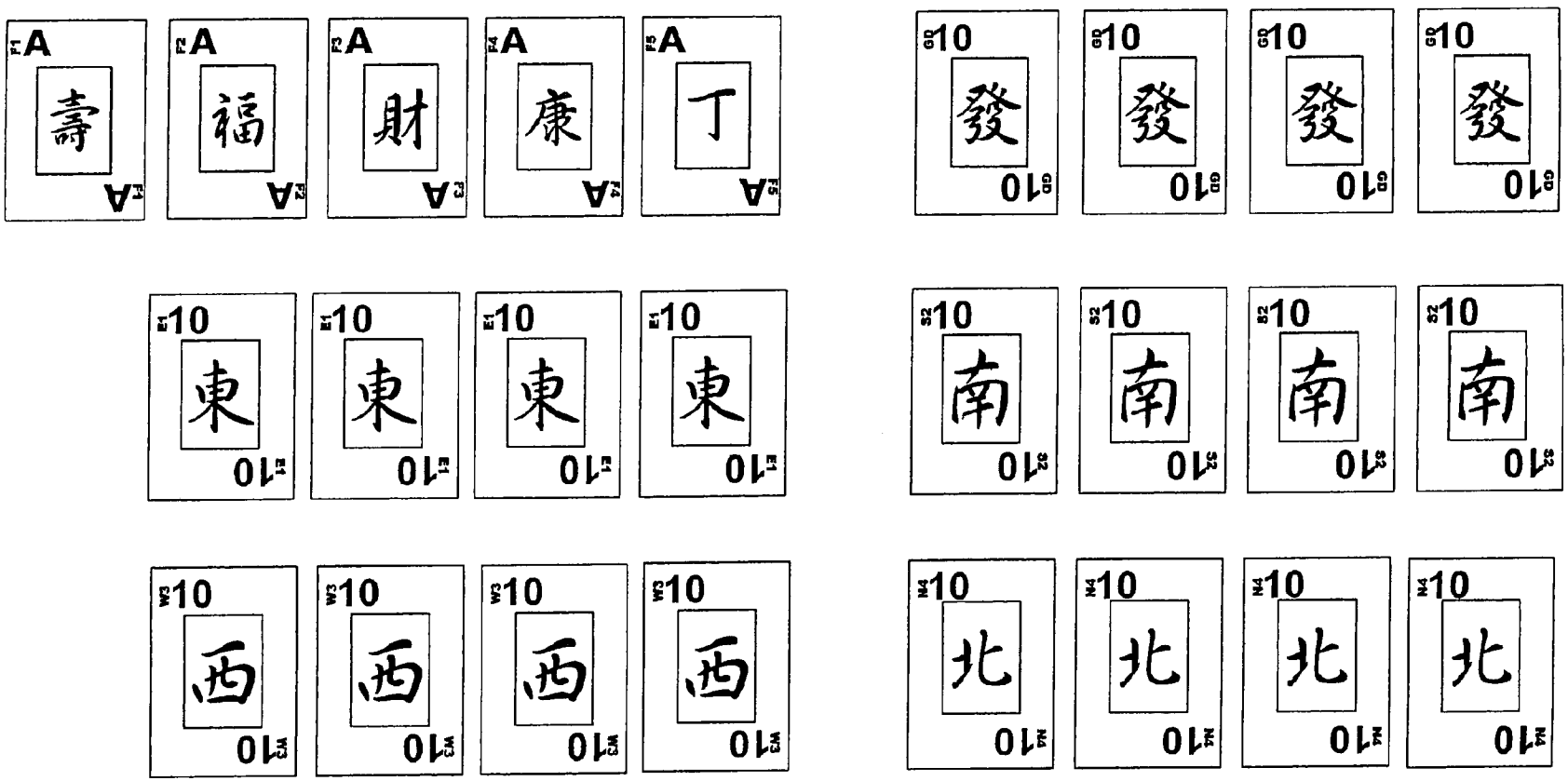
Figure 1. The Chinese Poker Deck (Top 25 cards)

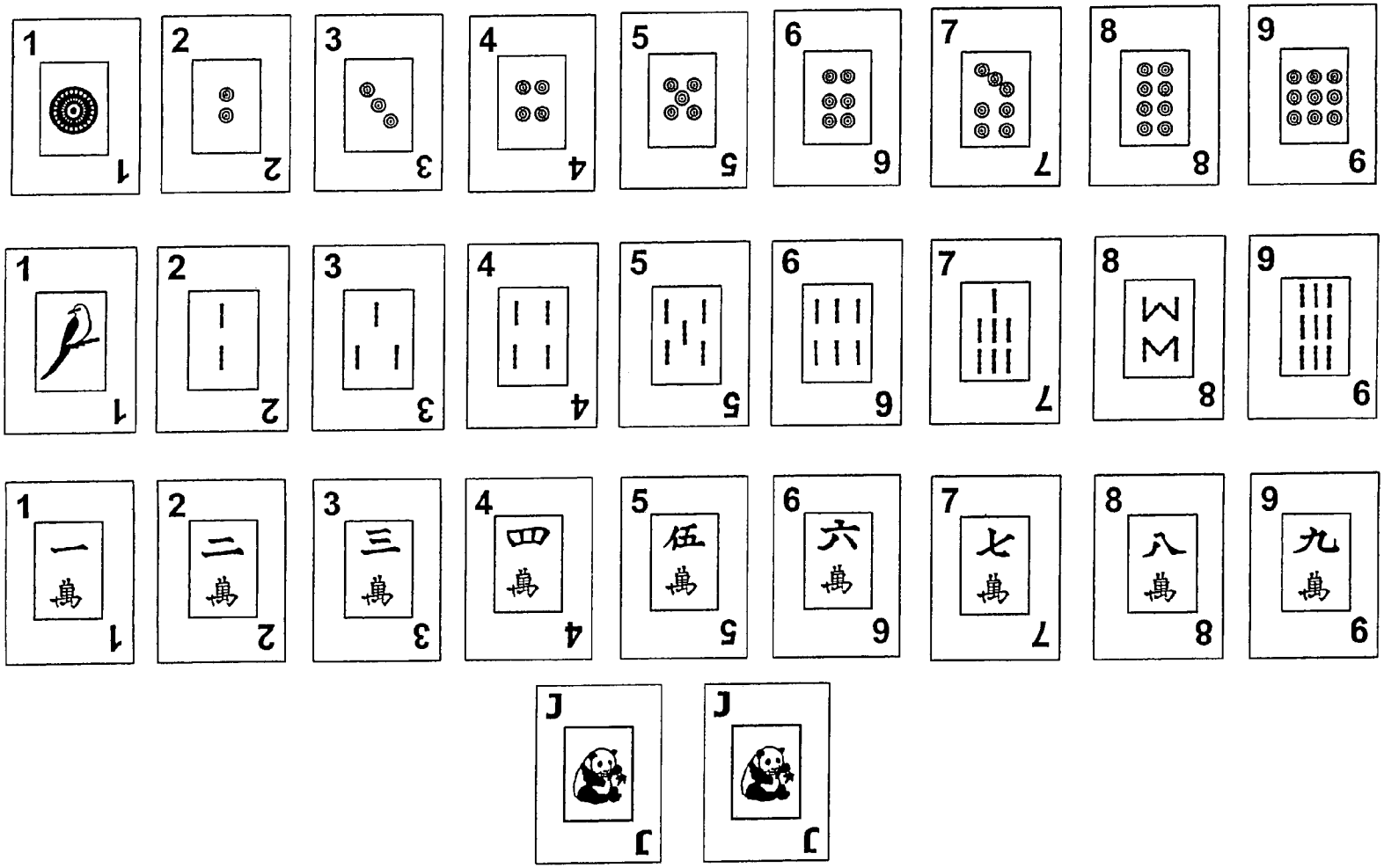
Figure 1 (Cont'd). The Chinese Poker Deck (Bottom 29 cards)

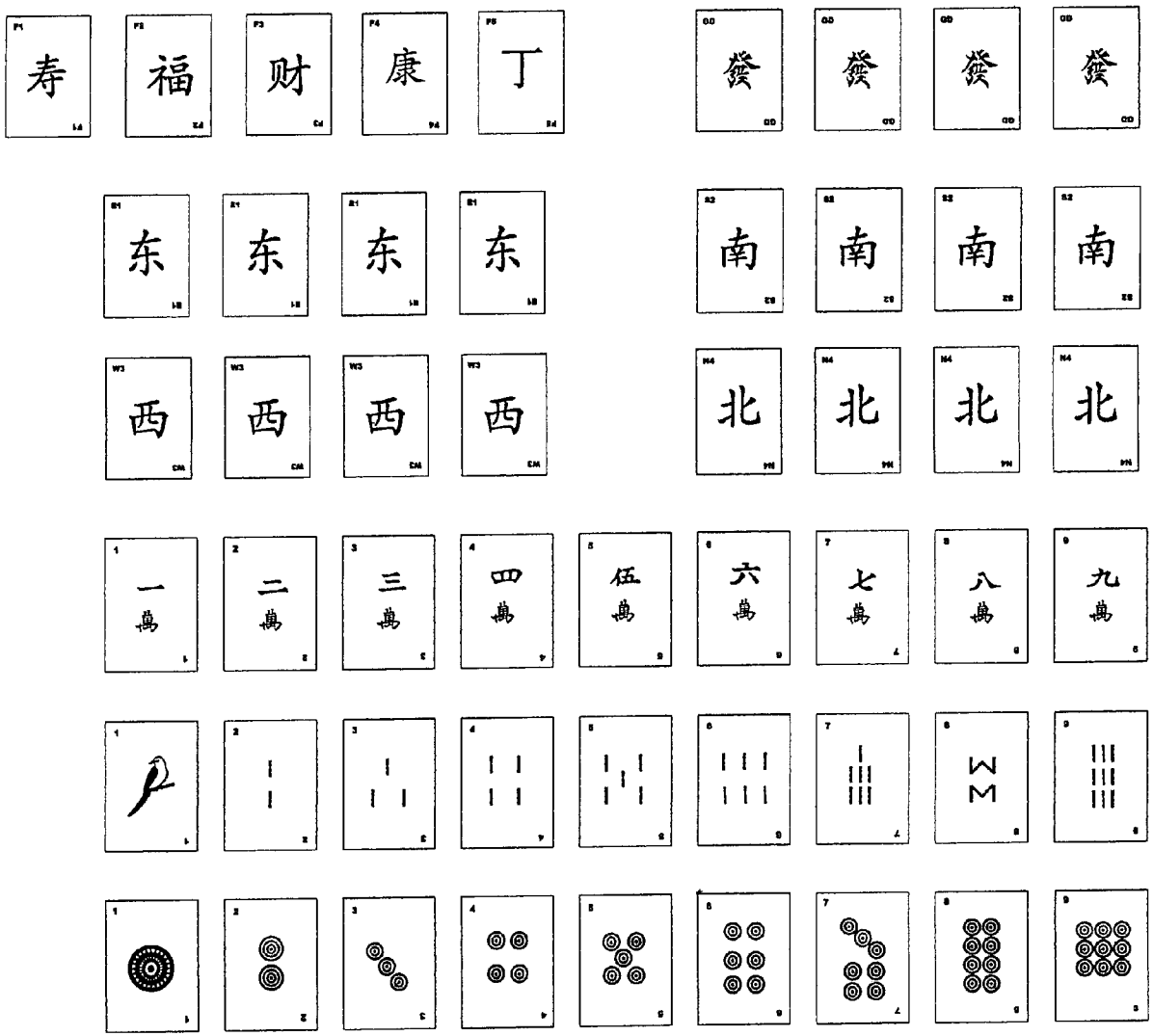
Figure 2. The ranking of the cards for the Chinese Poker Deck

TARACCAB OR BACCARAT TABLE CARD GAME WITH CHINESE DECK

CROSS-REFERENCE TO RELATED APPLICATIONS

The present application is a continuation-in part of U.S. application Ser. No. 11/058,471 filed Feb. 14, 2005, entitled "CHINESE POKER DECK," the disclosure of which is specifically incorporated herein by reference.

FIELD OF THE INVENTION

The present invention is in the field of gaming and, more particularly, gaming in the casino gambling industry.

BACKGROUND OF THE INVENTION

The casino gaming industry continually seeks to invent new gambling games in order to add flare to the old standbys such as Blackjack, Craps, Poker, Baccarat, etc. The object is to keep the gaming interest of both the old and the new customers high in order to maintain and grow the revenues and profits for the industry. In actuality, the so-called new games that have surfaced in recent years are rarely new but are takeoffs from older games. For example, Caribbean Stud is based on Stud Poker. So are Let It Ride and Three Card Poker. Notwithstanding, new games are still in great demand whether or not they are really new or are just takeoffs from the older standbys.

As we enter into the 21$^{st}$ century, the world as we have known it for many decades is undergoing profound changes right in front of our eyes that severely impact the well-being of our society. First and foremost is the end of the cold war between the Soviet Union and the United States which led indirectly to the breakup of the Soviet Empire. This event has changed many lives, both within and without the former Soviet Union. Many people living formerly under the Soviet rule are today enjoying their political freedom for the first time after many decades. More importantly, they have now become productive and free citizens once again in their new environments leading to significant economical gain because of their entrepreneurship and hard work.

The second profound change is the advent of the Internet starting as early as in the late 1970s. Although it took more than two decades including the notorious "WWW or World Wide Wait" period instead of "World Wide Web" for its ridiculously slow services in the beginning, and a gigantic bubble burst in the capital investment community shortly after the turn of the last century to prove to everybody that it is indeed one of the most important events that has taken place. The Internet, together with the tremendous advances in the silicon chip and the computer software technologies during the past two decades have literally ushered the world into the so-called Information Age. Today virtually everything in private and public commerce is done on the Internet leading to an unprecedented productivity gain in many sectors of industry.

The third event is the crystallization of a globalization process as a direct result of the coming of the Information Age. This globalization process simply means that all activities involving international commerce, trade, finance, communication and production of goods and services are taking place irrespective of continental, national, demographic or geographical boundaries as long as they are done in the most efficient and cost-effective manner. The globalization process is actually a two-edged sword. Whereas countries like China and India, whose economies have been benefited tremendously by the effects of globalization, other countries like the United States, European Union countries and even Japan have suffered significant negative effects like the loss of employment and the closing down of many factories that are no longer competitive in the world scene. Globalization is today an on-going process and nobody knows for sure what will eventually become of our world. One thing, however, is amply clear. China is presently experiencing a strong rise in its economical fortune.

During the past two decades, as more and more affluent Chinese and Asian gamblers, a direct result of the globalization process discussed above, came to Las Vegas and Atlantic City to play, there has been a growing sense of opportunity for the casinos to come up with new games in order to attract the attention of these new customers. If these new games can be devised based upon the cultural folklores and ancient concepts that the Chinese and Asian revere, such as Yin Yang (two opposing forces) and Feng Shui (wind and water), the chance of these new games being enthusiastically accepted by the new comers will be greatly enhanced. Furthermore, if these new games can blend the old and popular Chinese gambling games such as Mahjongg, Tin Gau, Sic Bo and Fan Tan (the so-called "Big Four"), with the traditional Western style gambling games such as Roulette, Poker, Blackjack etc., the so-called gaming fusion of the East and West, then the chance of success should even be greater.

While the need to create new games for casinos in the U.S., based upon the fusion of the culture and gambling methods of both the East and the West, is pretty much a no-brainer, its realization might not be as simple as one is led to believe. However, the observation that one of the gambling tools that is conspicuously missing in the East is the counterpart of the West's international 52-card pack which anchors many favorite Western gambling games, led the current inventor to recognize this unique opportunity and capture it by inventing a novel Chinese style poker deck called the "Chinese Poker Deck". The construct of this poker deck reflects not only its Western origin, but also allows the permeation of the Eastern culture by using elements of Mahjongg, the most beloved gambling game of the Chinese that dates back hundred of years, and also the ageless Chinese practice of Feng Shui, a revered cultural concept of the Chinese people throughout their more than 5,000 years of civilization.

The game of Baccarat, the favorite of the many high rollers, uses the international 52-card pack to play the game. It is today the fastest growing gambling game of the casino industry, particular in Macao, the Special Administration Region (SAR) of China where casino gambling is allowed. The object of the present invention is to create a counterpart of the casino game of Baccarat for the Chinese Poker Deck. It is called the casino game of "Taraccab™. The name "Taraccab" is derived from the name "Baccarat" by spelling the latter word backwards. The name of the casino game Taraccab™ therefore carries with it the balancing element for fusing the West and the East in the gaming industry. To reach out to the East from the West, one spells out "BACCARAT" in the direction from west to east. On the other hand, in order to reach out to the West from the East, one spells out "TARACCAB" in the direction from east to west. Therefore by inventing the game "Taraccab™", one further balances the East and West, not only with the Chinese Poker Deck pitching against the International 52-card pack, but also with the game of Taraccab™ pitching against the game of Baccarat.

SUMMARY OF THE INVENTION

The present invention is generally directed to a method of playing a novel game that has been coined the Taraccab™ game that uses at least one deck of cards comprised of three sets of cards with designations 1 through 9, five cards with a first designation ("F"), four cards with a second designation ("D"), four cards with a third designation ("E"), four cards with a fourth designation ("S"), four cards with a fifth designation ("W") and four cards with a sixth designation ("N"). The game is played by generating a player hand having two cards and a dealer hand having two cards, then using a preselected set of rules to determine whether the player hand and the dealer hand will receive one additional card and then, if appropriate, providing any additional card to any appropriate hand, and then declaring a winning hand between the player hand and the dealer hand, unless they both have identical cards, by determining whether the player hand or the dealer hand has the highest ranking for any two cards according to a set of numerical rankings of two cards.

In a separate group of aspects of the present invention, the preselected set of rules is the player hand can only receive one additional card if its first two cards have a ranking of a preselected number or less (such as 90) while the dealer hand can only receive one additional card if its first two cards have a ranking of a second preselected number or less (such as 100), wherein any combination of two cards has its own unique ranking within the set of numerical rankings in which each pair of cards is represented by the designations of each of its cards as follows: FF 120, DD 119, EE 118, SS 117, WW 116, NN 115, FD 114, FE 113, FS 112, FW 111, FN 110, F9 109, F8 108, F7 107, F6 106, F5 105, F4 104, F3 103, F2 102, F1 101, DE 100, DS 99, DW 98, DN 97, ES 96, EW 95, EN 94, SW 93, SN 92, WN 91, 99 90, 98 89, 97 88, 96 87, 95 86, 94 85, 93 84, 92 83, 91 82, 88 81, 87 80, 86 79, 85 78, 84 77, 83 76, 82 75, 81 74, 77 73, 76 72, 75 71, 74 70, 73 69, 72 68, 71 67, 66 66, 65 65, 64 64, 63 63, 62 62, 61 61, 55 60, 54 59, 53 58, 52 57, 51 56, 44 55, 43 54, 42 53, 41 52, 33 51, 32 50, 31 49, 22 48, 21 47, 11 46, D9 45, D8 44, D7 43, D6 42, D5 41, D4 40, D3 39, D2 38, D1 37, E9 36, E8 35, E7 34, E6 33, E5 32, E4 31, E3 30, E2 29, E1 28, S9 27, S8 26, S7 25, S6 24, S5 23, S4 22, S3 21, S2 20, S1 19, W9 18, W8 17, W7 16, W6 15, W5 14, W4 13, W3 12, W2 11, W1 10, N9 9, N8 8, N7 7, N6 6, N5 5, N4 4, N3 3, N2 2, and N1 1.

In another separate group of aspects of the present invention, at least one person is allowed to select either the player hand or the dealer hand as a betting hand and place a bet on the betting hand and even money is paid to any bet on the betting hand if the betting hand is the winning hand and the player hand or paying a preselected percentage (such as 90%) of the bet to any bet on the betting hand if the betting hand is the winning hand and the dealer hand, wherein the first preselected number is less than the second preselected number. The amount paid to any bet on the betting hand can be doubled if the winning hand has a preselected ranking, such as the ranking of 119.

In still another separate group of aspects of the present invention, a player is allowed to place a bet on the player hand and paid even money on the bet if the player's hand is the winning hand or the bet is doubled if the winning hand has a preselected ranking, such as the ranking of 119. At least two player's hands can be generated for each dealer hand and at least two players can be allowed to place a bet on one or more player's hands dealt to each player.

In still a further separate group of aspects of the present invention, the game is played with at least one deck of cards, and preferably with five decks, and the first designation is a feng shui designation, the second designation is a Green Dragon designation, the third designation is an East Wind designation, the fourth designation is a South Wind designation, the fifth designation is a West Wind designation and the sixth designation is a North Wind designation, while the three sets of cards with designations from 1 to 9 each have a different suit designation that corresponds to a Mahjongg suit designation.

Accordingly, it is a primary object of the present invention to provide a new game called Taraccab™ that has some similarities in play to Baccarat but which is different and uses a new deck of cards which is, preferably, a new deck of cards called the Chinese Poker Deck™.

This and further objects and advantages will be apparent to those skilled in the art in connection with the drawings and the detailed description of the preferred embodiment set forth below.

BRIEF DESCRIPTION OF THE DRAWINGS

FIG. 1 depicts a deck of cards, called the Chinese Poker Deck™, for use with the present invention.

FIG. 2 illustrates the point numbering convention for both a traditional poker deck and the Chinese Poker Deck™.

DETAILED DESCRIPTION OF THE INVENTION

Figure 3:
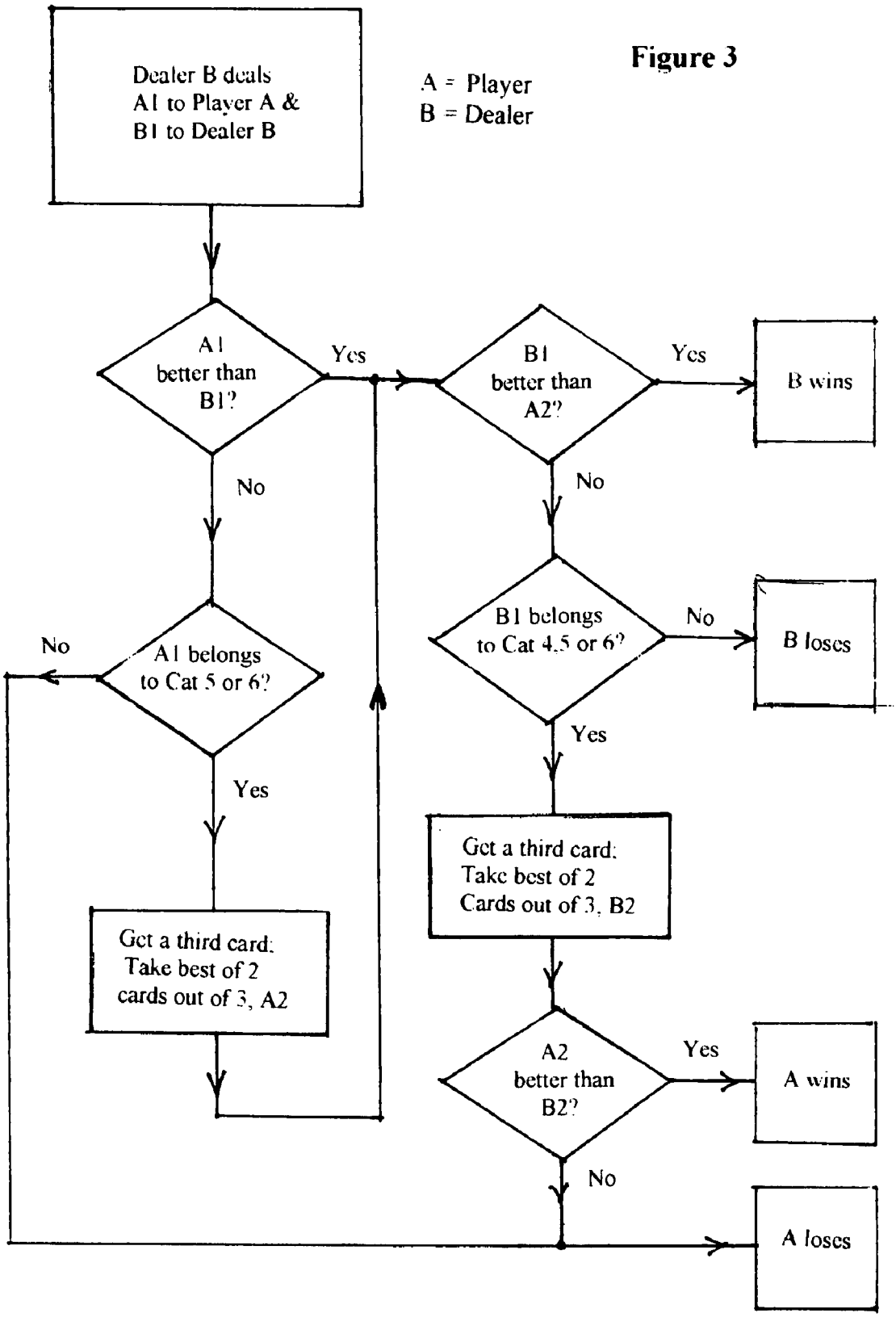
FIG. 3 is a flow chart for the claimed method of the present invention.

The present invention utilizes a new deck of cards that is disclosed in my earlier patent application cross-referenced above. The new deck of cards is referred to as the Chinese Poker Deck™ because, like a traditional poker deck (i.e., a deck of 52 cards, having four suits—clubs, diamonds, hearts and spades—each of which has 13 cards comprised of 2-10, Jack, Queen, King and Ace), it uses 52 cards, but the cards integrate various aspects of traditional Chinese games and culture. The result is a novel deck that allows the East to meet the West, and vice versa.

The Chinese Poker Deck is comprised of 27 numbered cards in three suits and 25 additional non-suit cards as shown in FIG. 1. The 27 numbered cards 1 are divided into three groups or suits—circles 2, bamboos 3 and scripts 4—each of which has nine cards numbered from 1 to 9. The 25 additional non-suit cards 5 are divided into 16 wind cards 6 (which is subdivided into four groups representing East 7, South 8, West 9 and North 10 winds, and each wind has four identical cards), 4 Green Dragon cards 11 (each of which is identical) and 5 Feng Shui cards 12. The 5 Feng Shui cards 12 are ranked from 1 to 5, 1 being the highest, and each bears a unique Feng Shui parameter designation which, in an especially preferred embodiment, represents, from 1 to 5, respectively, Longevity, Luck, Wealth, Health and Fertility. The wind and dragon cards might be compared to face cards in a traditional poker deck in that each such card is assigned a value of 10 in games in which the cards need to have a number value, such as in the game of Blackjack, while the five Feng Shui cards are assigned a value of 11 in such games.

The incorporation of the three suits of circles 2, bamboos 3 and scripts 4 into the Chinese Poker Deck ties the deck to the traditional Chinese game of Mahjongg which uses the same three suits. Similarly, Mahjongg also uses the four winds as well as dragons (typically green, red and white). However, unlike Mahjongg, the Chinese Poker Deck uses such symbols and designations in a new context, i.e., the context of a deck of 52 cards. Thus, the Chinese Poker Deck at once invokes a certain feeling of familiarity to one familiar with Mahjongg, while the 52 card deck also invokes a certain feeling of familiarity to one familiar with the traditional poker deck (international 52-card pack).

The Chinese Poker Deck departs from any similarity to Mahjongg by the addition of the five Feng Shui cards 5 (see FIG. 1) which are not found in Mahjongg. Because of the pull of Feng Shui in the Chinese and Eastern culture, even though Feng Shui is not incorporated into Mahjongg, its addition to the Chinese Poker Deck brings an additional type of familiarity to those familiar with its precepts. In addition, because there are 5 such cards, it allows the Chinese Poker Deck to be perfectly rounded out to 52 cards so as to maintain the same number of cards found in the traditional poker deck.

The discussion set forth in the background to the invention above led the inventor to the conclusion that a Chinese Poker Deck had to be invented, or created from scratch, but based upon the Eastern cultural thinking and concept of the original Western 52-card pack in order to take full advantage of the affluent Chinese and Asian gamblers visiting Las Vegas or Atlantic City of the United States and Macao of China in the coming years. To just invent the Chinese Poker Deck as the current inventor has done is only the beginning in achieving the ultimate fusion and the cultural balance of the East and the West in the casino gaming industry. It is the object of the present invention to devise a casino game called Taraccab™ using the Chinese Poker Deck™ to rival the game of Baccarat. The reasons for doing so are digressed below.

First and foremost is the fact that Baccarat is a very simple game to play. One uses the international 52-card pack to play Baccarat. The object of the game is to place a bet on the winning hand. Regardless of how many players are at the table, only two hands are dealt: one hand for the banker and another for the player. Based upon the international 52-card pack, all tens and face cards (jack, queen and king) are worth zero. The ace is worth "1" and the Two "2" through Nine "9" are worth their face value. Card suits have no meaning in Baccarat. The total of the hand, regardless if it consists of two or three cards, is determined by summing up the values of the cards in the hand. When the total of the hand is 10 or more, 10 must be subtracted and the remaining total is the card count. Because of the fast turnover way Baccarat is played in the casinos, it is not only a favorite among casino visitors, it is more so by the casino owners. This is because the more Baccarat hands that are played in a particular time period, the more profit owners stand to make according to the odds they enjoy for the game.

Baccarat is considered by many as one of the "no-brainer" casino games available to play. This is because to play the game the player does not have to make any decisions after a bet is placed. The rules are automatic. It means that the Dealer at the table acts according to these rules without consulting the players. The player has only to listen to the Dealer to find out which hand has won. Amazing as it may sound to most people, gamblers, especially many of the high rollers, prefer playing casino games that do not require thinking of any sort. Even popular games like the Blackjack or the Craps would be considered by them as requiring too much thinking to play. The single most important goal for many casino visitors is to try their luck and win. That is the reason why the popularity of Baccarat has grown so rapidly in recent years.

Second, a player playing the game of Baccarat can have three betting options. They are 1) Betting on the Player Hand; 2) Betting on the Bank Hand and 3) Betting on a Tie Hand. The fact that a player can bet on "either side of the aisle", so to say, makes the player feel very secure from the fairness viewpoint for the game. However, when the player bets on the Banker Hand or the Tie Hand, the player has to pay a five percent (5%) commission to the Dealer or House if he wins, a disadvantage generally regarded as being unimportant by most Baccarat players.

Third, although we have previously considered the game of Baccarat as very simple to play, it is in fact not quite so. The so-called "Drawing Rules" are actually quite complicated and depend upon both the Player and Banker Hands. However, the players do not have to remember these drawing rules as it is the dealer's responsibility to execute these rules to the respective hands before declaring the winning hand. Nevertheless, from the player's standpoint, these drawing rules could be considered as making the game rather non-transparent. In other words, they must rely upon the dealer to execute these rules correctly before declaring the winning hand.

It is the object of the present invention to invent a casino game called Taraccab™ played with the Chinese Poker Deck™ to rival the game of Baccarat played with the international 52-card pack. Like Baccarat, the object of Taraccab™ is to place a bet on the winning hand. Paralleling Baccarat, regardless of how many players are at the table, only two hands are dealt: one hand for the banker and another for the player. The dealer will deal two cards, face up, each to the Player hand and Banker hand. Depending on the composition of the two cards, each hand will either stand or draw one card to improve its ranking. The major difference between playing the Taraccab™ game using the Chinese Poker Deck™ and the Baccarat game using the international 52-card pack is the fact that whereas for Baccarat, the value of a hand is determined by summing up the number counts of the cards in the hand (each card has a unique number count), the value of a hand for Taraccab™ is determined by the ranking of the two cards in the hand or if the player has drawn an extra or third card, then the ranking of the two best cards in the hand.

Thus, each individual card in the Chinese Poker Deck (52 cards) is ranked. Starting with the five Feng Shui cards, they represent the highest ranking cards of the deck although the five different Feng Shui parameters all have the same ranking. Next comes the four Green Dragon cards then followed by the wind direction cards starting with the East being the highest among the group followed by South, then West and North respectively. The three suits of the deck, namely Circles, Bamboos and Scripts, have no ranking significance among them in the game of Taraccab™. The Nine (9) of each suit represents the highest followed by Eight (8), Seven (7) etc. down to One (1). Also, whereas a pair of Feng Shui, Green Dragon, East, South, West and North cards add significantly to the value of the two-card hand, the pairs of numbers in the three suits do not add any value to the two-card hand comprising them.

Because of the fact that the value of a Taraccab™ hand does not require a summing operation for the number counts of the cards making up the hand, like in the case of Baccarat, rather, simply recognizing the familiar rankings for the cards making up a Taraccab™ hand suffices to determine its value, the playing of Taraccab™ should in principle be slightly faster than that for Baccarat. This is especially true for those players who are familiar with the playing of the Mahjongg game and therefore readily recognize the cards. As far as the drawing rules for the Taraccab™ game is concerned, it is also much simpler than the counter part for Baccarat (see below). To the players, therefore, the drawing rules for the Taraccab™ game are very much more transparent than the counterparts for Baccarat. Also for the Baccarat game, the Tie hand occurs quite often leading to a slight disadvantage as far as earning profit is concerned for the casino owners. For the Taraccab™ game, however, the Tie hand occurs only very sparingly, adding to the liking for the casino owners for this game. Finally, one major advantage which favors the Taraccab™ game is the fact that whereas the favoring odds for the dealer between the Baccarat and Taraccab™ games is about the same, hovering around 1.0-2.0%, whether the player bets the Player or the Banker hand, the Baccarat game never pays a bonus. Taraccab™ on the other hand can pay a special bonus (two for one) when either the Player or the Banker hand wins with a pair of Green Dragon. This special game feature will no doubt please the casino visitors more for the Taraccab™ than the Baccarat game as more players are made aware of this fact in the future. Also, a pairing of Green Dragon cards as a bonus hand is sure to please players familiar with the concept of the Green Dragon found in Mahjongg.

The details of playing Taraccab™ will now be discussed in greater detail in a mathematical analysis of Taraccab™ prepared by an independent gaming expert who regularly analyzes new games for the Nevada Gaming Commission and State Control Board.

Rules of Play

Taraccab™ is a new table game played with five customized decks of cards. Each deck is composed of:

5 Feng Shui cards,
4 Green Dragon cards,
4 East cards,
4 South cards,
4 West cards,
4 North cards, and
3 different sets of cards numbered 1 through 9.

Thus each deck has 52 cards.

The game is similar to baccarat in that the player has the option to place a bet on either a Player hand or a Banker hand. The object of the game is to win the hand that you bet on. The dealer will deal two cards, face up, each to the Player hand and Banker hand. Depending on the composition of the two cards, each hand will either stand or draw one card to improve its ranking. The individual card rankings are shown below, from highest to lowest:

Feng Shui
Green Dragon
East
South
West
North
9, 8, 7, 6, 5, 4, 3, 2, 1.

Only the best two cards of each hand are used. There are 120 distinct 2-card hands which are categorized into six "classes." Below is a list of all the 2-card hands with their respective ranking under each class, with an FF (i.e., any two Fend Shui cards) ranked the highest at 120:

| Legend | | | |
|---|---|---|---|
| F . . . Feng Shui | D . . . Green Dragon | E . . . East | S . . . South |
| W . . . West | N . . . North | | |

Class I: 120-115
FF 120
DD 119
EE 118
SS 117
WW 116
NN 115
Class II: 114110
FD 114
FE 113
FS 112
FW 111
FN 110
Class III: 109-101
F9 109
F8 108
F7 107
F6 106
F5 105
F4 104
F3 103
F2 102
F1 101
Class IV: 100-91
DE 100
DS 99
DW 98
DN 97
ES 96
EW 95
EN 94
SW 93
SN 92
WN 91
Class V: 90-46
99 90
98 89
97 88
96 87
95 86
94 85
93 84
92 83
91 82
88 81
87 80
86 79
85 78
84 77
83 76
82 75
81 74
77 73
76 72
75 71
74 70
73 69
72 68
71 67
66 66
65 65
64 64
63 63
62 62
61 61
55 60
54 59
53 58
52 57
51 56
44 55
43 54
42 53

41 52
33 51
32 50
31 49
22 48
21 47
11 46
Class VI: 45-1
D9 45
D8 44
D7 43
D6 42
D5 41
D4 40
D3 39
D2 38
D1 37
E9 36
E8 35
E7 34
E6 33
E5 32
E4 31
E3 30
E2 29
E1 28
S9 27
S8 26
S7 25
S6 24
S5 23
S4 22
S3 21
S2 20
S1 19
W9 18
W8 17
W7 16
W6 15
W5 14
W4 13
W3 12
W2 11
W1 10
N9 9
N8 8
N7 7
N6 6
N5 5
N4 4
N3 3
N2 2
N1 1

As in Baccarat, the Banker hand has an inherent edge over the Player hand because the draw rules, by design, slightly favor the Banker hand. Whereas the Player hand should draw a card if the first two cards fall within Class V or VI, the Banker hand should draw a card if the first two cards fall within Class IV, V or VI. A hand must stand if it does not fall within any of its predetermined classes that call for a draw. Only the best two of the three cards are used after a draw.

After the house dealer plays out both hands according to the rules, the outcome of the game will be adjudicated by the rankings of the two hands. Whichever hand has the higher ranking wins. Winning bets are paid even money, but a winning Banker bet is charged a 10% commission. In the event of a tie, it is a push with no money changing hands.

In a second version of the game, any hand comprising a pair of Green Dragons will win double if it beats the other hand.

Mathematical Analysis

A computer program was written to analyze the game. The analyzer cycled through all 120 initial player two-card hands versus all 120 initial two-card Banker hands. (In most cases only one comparison is required since the hands as well as the draw rules are symmetrical the majority of the time. For example, a Player F9 versus a Banker FE results in a loss for the Player hand, which would be a loss for the Banker hand if the hands are swapped.) For each player two-card hand versus each two-card Banker hand, the analyzer played out the hands according to the rules and determined the expectation for each hand. As soon as all hands were examined, the house advantage for each hand was determined.

The frequency of occurrence of all two-card hands under each class is shown below:

TABLE 1

| Class | % Frequency |
|---|---|
| I | 3.7125 |
| II | 7.4250 |
| III | 10.0238 |
| IV | 11.8800 |
| V | 26.8637 |
| VI | 40.0950 |

Version 1

The Player hand would win 48.11% of the time, lose 50.47% of the time, and push 1.42 of the time. The house advantage on the Player hand is 50.47%−48.11%=2.36%.

As the losing probability of the Player hand is the winning probability of the Banker hand, the house advantage on the Banker hand is 50.47%×10%−2.36%=2.68%.

Version 2

In version 2 a winning hand containing a pair of dragons will be paid 2 to 1.

The Player hand would win even money 46.98% of the time, win double 1.13% of the time, lose 50.47% of the time, and push 1.42 of the time. The house advantage on the Player hand is 50.47%−(46.98%×1+1.13%×2)=1.24%.

The Banker hand would win even money 49.00% of the time, win double 1.48% of the time, lose 48.11% of the time, and push 1.42 of the time. The house advantage on the Banker hand is 48.11%−(49.00%×1+1.48%×2)×0.9=1.35%.

While the game of Taraccab™ has so far been described in a manner suitable for play similar to how Baccarat games are presently played in Macao, China, the game can easily be adapted for play that might be more suitable if a more Western-style of play is desired, such as might be found in Las Vegas. For example, instead of playing two hands and allowing anyone to bet on either hand, the game can be adapted for play at present Blackjack tables in which one or more players can play one or more hands and be betting against the house. In such an adaptation, all of the cards need not be dealt face up in the beginning, just as all of the cards are not dealt face up in present blackjack games played in Las Vegas. Instead, one card from each hand might be dealt face up and then a first player hand would reveal the player's second card and the dealer would reveal the dealer's second card. The play would then proceed with the first player's hand until a winner is determined. If the dealer is able to take a third card but does not need to do so to beat the first player's hand, the dealer would then proceed to the second player's hand and follow the rules until a winner is determined for that hand, and so on, until all player's hands have been played. Of course, such a game can also be played in which all of the cards are dealt face up from the start. The major difference between this variant of Taraccab™ and that which is described in great detail above is that a player would be betting on the player's own hand against the dealer's own hand, which is a much more individualistic way of playing than allowing every player to either bet on one player's hand or the dealer's hand. However, such an adaptation would still follow the same general rules of play for determining which hand is a winner and when a third card can be drawn.

While the invention has been described herein with reference to certain preferred embodiments, those embodiments have been presented by way of example only, and not to limit the scope of the invention. Additional embodiments thereof will be obvious to those skilled in the art having the benefit of this detailed description. Further modifications are also possible in alternative embodiments without departing from the inventive concept. For example, just like there are many variants on the game of poker, there can be many variants to the play, rules and characteristics of the Taraccab™ game set forth in this disclosure. Such variants might include changing the amount paid for a bonus bet, or changing when the bonus bet might be paid, or changing the rake taken when a bet is made on the dealer's hand. Also, while the present disclosure has focused on the use of a Chinese Poker Deck™ set of cards, because of the obvious synergy to be gained by promoting use and play of such deck with the Taraccab™ game, the Taraccab™ game can be played with any deck of cards in which the cards are constructed so as to preserve the same mathematical characteristics of play; for example, although the present inventor believes such a deck of cards would be less desirable, the deck could be configured with 5 aces or 11s, five different groups of four cards each having their own designation, and three sets of cards having values of 1-9.

Figure 4:
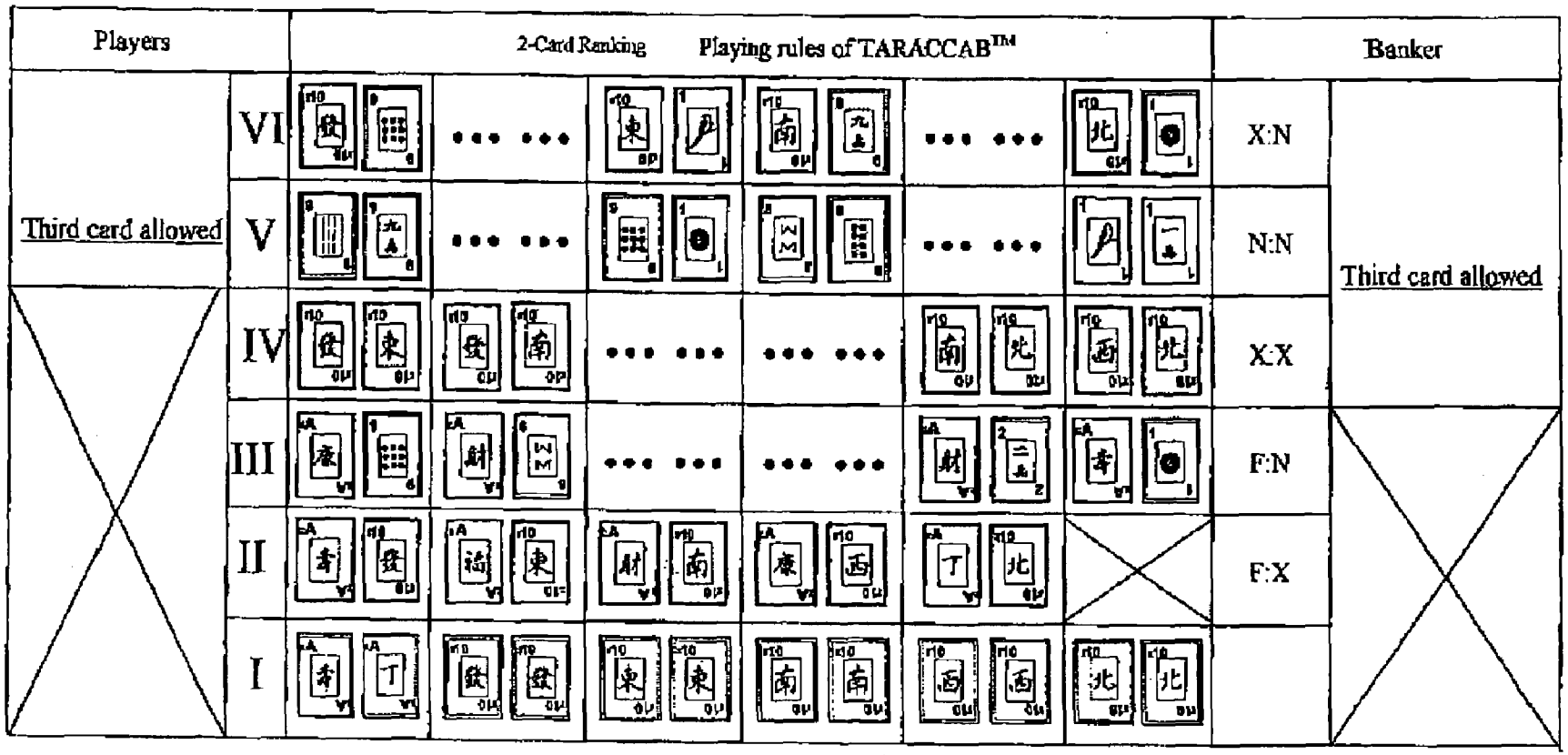
FIG. 4 illustrates the playing rules for the game of TARACCAB™ according to the present invention.

The playing rules for TARACCAB™ are conveniently summarized in FIG. 4. For ease of reference, the three groups of cards critical to recognition of a hand ranking are given the following nomenclature in the left column under Banker: "F" is a card in the Feng Shui group of cards, "N" is a card in the numerical group of cards (i.e., numbers 9-1 in the three suits) and "X" is a card in the non-numerical group of cards representing Green Dragon, East Wind, South Wind, West Wind and North Wind. In addition, the internal ranking of cards within any class, from greatest to least, are illustrated horizontally in the rows to the left of the classes listed in the right column under Players; for example, in class 1, the highest ranking is a pair of Feng Shui cards, the next highest ranking cards in the numerical group of cards are given whereas in class 6 the highest ranking set of cards is set forth at the left and then the sets to the right decrease in ranking (but do not illustrate all possibilities).

Accordingly, it will be apparent to those skilled in the art that still further changes and modifications in the actual concepts described herein can readily be made without departing from the spirit and scope of the disclosed inventions as defined by the following claims.

What is claimed is:

1. A method for playing a casino card game for at least one player, the game method using playing cards, comprising:

the player placing a wager based upon the outcome of a winning hand between a player hand and a dealer hand;

a dealer dealing two cards to the player hand and two cards to the dealer hand;

determining if the player hand is better than the dealer hand and, if it is not, declaring the dealer hand the winning hand if the player hand belongs to a class 1 through 4 hand or dealing the player hand a third player hand card and then determining if the player hand is better than the dealer hand and, if it is not declaring the dealer hand the winning hand or if it is declaring the player hand the winning hand if the dealer hand belongs to a class 1 through 3 hand or dealing the dealer hand a third dealer hand card and then declaring the better hand between the player hand and the dealer hand the winning hand; and settling the wager based upon the winning hand;

wherein the class rankings are based upon identifying whether the cards are in a first, a second or a third group of cards which are then used to form the class rankings and, then for determining rankings within the class rankings, using either a first ranking system for cards in the first group of cards or a second ranking system for cards in the second group of cards; and wherein a hand having a card from the third group of cards will have a ranking of class 1, 2 or 3 depending upon the second card in the hand and a pairing of any two identical cards in the second group of cards will also have a class 1 ranking but be inferior to a pair of class 3 cards; and wherein a hand having a card from the third group of cards and the second group of cards will have a class 2 ranking while a hand having a card from the third group of cards and the first group of cards will have a class 3 ranking; and wherein two non-identical cards in the second group of cards will have a class 4 ranking, two cards from the first group of cards will have a class five ranking, and one card from the first group of cards combined with one card from the second group of cards will have a class 6 ranking.

2. The method of claim 1, wherein the playing cards are comprised of at least one deck of cards in which there are five cards in the third group of cards, twenty-seven cards in the first group of cards with three cards having each of the designations of 9, 8, 7, 6, 5, 4, 3, 2 and 1, respectively, and twenty cards in the second group of cards with there being five sets of four identical cards.

3. The method of claim 2, wherein the five cards in the third group of cards have a feng shui designation and the five sets of four identical cards have the designations of a Green Dragon, an East Wind, a South Wind, a West Wind and a North Wind.

4. The method of claim 3, wherein the second ranking system for cards in the second group of cards is that a Green Dragon designation is higher than an East Wind designation which is higher than a South Wind designation which is higher than a West Wind designation which is higher than a North Wind designation.

5. The method of claim 4, wherein the first ranking system for cards in the first group of cards is that a higher number designation beats a lower number designation.

6. A method for playing a casino card game for at least one player, the game method using playing cards, comprising: the player placing a wager on a first hand or a second hand; a dealer dealing two cards to a first hand and two cards to a second hand; determining which of the first and second hands is a low hand and which is a high hand by comparing the ranking of the first two-card hand to the ranking of the second two-card hand based upon which hand has a lower class ranking or, if each hand has the same class of ranked hands, determining which hand has a lower ranking in said same class of ranked hands and if the low hand has a ranking above a minimum required to draw a third card, declaring the high hand a winning hand, or, if the low hand has a ranking below the minimum required to draw the third card, dealing the third card to the low hand and then determining if the low hand is now higher than the high hand and, if it is not, declaring the high hand the winning hand or, if it is, then declaring the low hand the winning hand if it the high hand's ranking is above the minimum required to draw the third card or, if it is not, then dealing the high hand its third card and declaring the winner to be the hand with the highest ranking based upon two of its cards; and settling the wager based upon whether the first or the second hand is declared the winning hand; wherein the class rankings are based upon identifying whether the cards are in a first, a second or a third group of cards which are then used to form the class rankings and, then for determining rankings within at least two of the class rankings, using either a first ranking system for cards in the first group of cards or a second ranking system for cards in the second group of cards.

7. The method of claim 6, wherein the playing cards are comprised of at least one deck of cards in which there are five cards in the third group of cards, twenty-seven cards in the first group of cards with three cards having each of the designations of 9, 8, 7, 6, 5, 4, 3, 2 and 1, respectively, and twenty cards in the second group of cards with there being five sets of four identical cards.

8. The method of claim 7, wherein the five cards in the third group of cards have a feng shui designation and the five sets of four identical cards have the designations of a Green Dragon, an East Wind, a South Wind, a West Wind and a North Wind.

9. The method of claim 8, wherein the second ranking system for cards in the second group of cards is that a Green Dragon designation is higher than an East Wind designation which is higher than a South Wind designation which is higher than a West Wind designation which is higher than a North Wind designation.

10. The method of claim 9, wherein the first ranking system for cards in the first group of cards is that a higher number designation beats a lower number designation.

11. The method of claim 10, wherein the minimum ranking required to draw the third card for a player hand is a class 5 or 6 ranking and for a dealer hand is a class 4, 5 or 6 ranking.

12. A method for playing a casino card game for at least one player, the game method using playing cards, comprising:

the player placing a wager on a first hand or a second hand;

a dealer dealing two cards to a first hand and two cards to a second hand;

determining whether the first hand or the second hand is a low hand by comparing the ranking of the first two-card hand to the ranking of the second two-card hand based upon which hand has a lower class ranking from six categories of ranked hands or, if each hand has the same class of ranked hands, determining which hand has a lower ranking in said same class of ranked hands and if the low hand is the first hand and the first hand has a ranking of from 1 to 4 in the six categories of ranked hands declaring the second hand a winning hand whereas if the low hand is the second hand and the second hand has a ranking for from 1 to 3 in the six categories of ranked hands declaring the first hand the winning hand, and if no hand is declared the winning hand, proceeding to the next step of:

dealing a third card to the low hand and then determining if the low hand is now higher than the other hand and, if it is not, declaring the other hand the winning hand or, if it is, then declaring the low hand the winning hand if the other hand is the first hand and it has a ranking of from 1 to 4 in the six categories of ranked hands or if the other hand is the second hand and it has a ranking of from 1 to 3 in the six categories of ranked hands and, if the low hand is not declared the winning hand, dealing the other hand a third card and then declaring the winning hand based upon the highest ranking of two out of three cards in either the first or the second hands, and settling the wager based upon whether the first or the second hand is declared the winning hand;

wherein the playing cards are based upon one or more decks of 52 playing cards having a first group of twenty-seven cards each of which has a number designation from 1 to 9, there being three cards of each such number designation; a second group of twenty cards, said twenty cards being evenly divided into five groups of four identical cards having a first, a second, a third, a fourth and a fifth non-numerical designation; and a third group of five cards having a unique sixth designation;

wherein the categories of rankings are as follows:

a class 1 ranking, from highest to lowest in said class 1 ranking, of a pair of cards with the unique sixth designation, followed by a pair of cards having the first, second, third, fourth and fifth non-numerical designations, respectively;

a class 2 ranking, from highest to lowest in said class 2 ranking, of one card with the unique sixth designation and a second card having the first, the second, the third, the fourth or the fifth non-numerical designation designations, respectively;

a class 3 ranking, from highest to lowest in said class 3 ranking, of one card with the unique sixth designation and a second card having the number designation 9, 8, 7, 6, 5, 4, 3, 2 or 1, respectively;

a class 4 ranking, from highest to lowest in said class 4 ranking, of two non-matched cards having the highest ranking combination of cards when the highest ranking cards are based upon the following decreasing order of ranking: first, second, third, fourth an fifth designations, respectively, so that the highest two cards are the first and second designations while the lowest two cards are the fourth and fifth designations;

a class 5 ranking of two cards with numerical designations, the highest ranking being based upon the highest of the two cards with the highest number so that two cards having designations of 9 and 1 are higher than two cards having designations of 8 and 8, two cards of 9 and 9 being the highest class 5 combination, two cards of 1 and 1 being the lowest class 5 combination; and a class 6 ranking of two cards with a first card having one of the first through fifth non-numerical designations and a second card having a numerical designation of from 9 to 1, the highest combination having the highest of the first through fifth non-numerical designations ranked, from highest to lowest, of first, second, third, fourth and fifth, respectively, while a higher numerical designation is ranked higher than a lower numerical designation, and a higher non-numerical designation is ranked higher than a higher numerical designation, so that two cards with the first non-numerical designation and the numerical designation of 1 have a higher ranking than two cards with the second non-numerical designation and the numerical designation of 9, the highest ranking in class 6 being the first non-numerical designation and the numerical designation of 9, the lowest ranking in class of 6 being the fifth non-numerical designation and the numerical designation of 1.

13. The method of claim 12, wherein the first through fifth non-numerical designations are, respectively, a Green Dragon, an East Wind, a South Wind, a West Wind and a North Wind.

14. The method of claim 13, wherein the unique sixth designation is a Feng Shui designation.

* * * * *